US010703551B2

(12) United States Patent
Chen

(10) Patent No.: US 10,703,551 B2
(45) Date of Patent: Jul. 7, 2020

(54) MOISTURE-PROOF STORAGE CAN

(71) Applicant: Wei-Ling Chen, Taichung (TW)

(72) Inventor: Wei-Ling Chen, Taichung (TW)

( * ) Notice: Subject to any disclaimer, the term of this patent is extended or adjusted under 35 U.S.C. 154(b) by 26 days.

(21) Appl. No.: 16/185,536

(22) Filed: Nov. 9, 2018

(65) Prior Publication Data

US 2020/0148446 A1 May 14, 2020

(51) Int. Cl.
*B65D 81/20* (2006.01)
*B65D 81/26* (2006.01)
*B65D 21/08* (2006.01)

(52) U.S. Cl.
CPC ..... *B65D 81/2038* (2013.01); *B65D 21/086* (2013.01); *B65D 81/263* (2013.01)

(58) Field of Classification Search
CPC . B65D 81/2038; B65D 21/086; B65D 81/263
USPC ..... 220/4.21–4.24, 231; 141/65
See application file for complete search history.

(56) References Cited

U.S. PATENT DOCUMENTS 5,540,557 A * 7/1996 Carson ..... B65D 81/2023 141/65
5,803,282 A 9/1998 Chen et al.
9,370,791 B1 * 6/2016 Nguyen ..... F04B 53/127
2003/0183657 A1 * 10/2003 Chang ..... B65D 81/2038 222/383.1
2004/0155041 A1 * 8/2004 Kwon ..... A47J 47/10 220/212
2015/0344180 A1 * 12/2015 Shakoori Divani . B65D 21/086 206/459.1
2017/0174411 A1 * 6/2017 Lonner ..... B65D 43/02
2019/0031398 A1 * 1/2019 Ho ..... B65D 43/0231
2019/0300223 A1 * 10/2019 Wu ..... B65D 1/0246

* cited by examiner

*Primary Examiner* — James N Smalley
(74) *Attorney, Agent, or Firm* — Muncy, Geissler, Olds & Lowe, P.C.

(57) ABSTRACT

The present invention includes an inner holder, an outer can, a first check valve and a second check valve. The inner holder includes a storage space. The outer can includes a slidable variable space for the inner holder to slide therein and an air channel for the slidable variable space to communicate with an exterior. The inner holder includes an air hole for the storage space to communicate with the slidable variable space. The first check valve is provided on the air hole and has an airflow direction towards the slidable variable space. The second check valve is provided on the air channel and has an airflow direction towards the exterior. The outer can is slidably moved outwards relative to the inner holder to suck out the air in the storage space and then slidably moved inwards relative to the inner holder to discharge air to the exterior.

9 Claims, 6 Drawing Sheets

MOISTURE-PROOF STORAGE CAN

FIELD OF THE INVENTION

The present invention relates to a storage can, and particularly to a moisture-proof structure of a storage can.

BACKGROUND OF THE INVENTION

A storage can is able to hold various commodities, for example, foods, tea leaves and coffee beans that need to be kept dry. A conventional storage can provide only an airtight effect, and blocks external air from entering therein so as to prevent the commodities from absorbing moisture in the air and thus from damping the commodities. However, each time when a storage can is opened, the commodities come into contact with new external air and absorb new moisture. As a result, with such repeated opening and closing of a storage can, it is possible that the commodities in the container become damped.

To reduce the moisture absorbed by the commodities in a storage can, a unidirectional air valve is conventionally disposed on a can body or cover of a storage can, and a vacuum device is used to suck out the air in the storage can after the storage can is closed, hence keeping a negative pressure state in the storage can. Thus, the amount of air with which the commodities in the storage come into contact can be reduced and the commodities are then prevented from damping.

To prevent a user from being unable to find an available vacuum device such as a vacuum cleaner or an air extraction rod, for example, the U.S. Pat. No. 5,803,282, "Vacuum Indicator for a Bottle", discloses a storage can that can be vacuumed. An air pump element is directly designed on a cover of the storage can to allow a user to use the air pump device to pump out the air in the storage can. However, in such conventional design and structure, the air pump element frequently has issues of inappropriate use or damage by external forces. Further, the structure of the outer cover thereof is quite complex, and thus has issues of a high defective rate and high assembly costs.

SUMMARY OF THE INVENTION

Therefore, it is a primary object of the present invention to disclose a moisture-proof storage can having easy manufacturing and assembly processes and not easily damaged during use.

According to the above object, a moisture-proof storage can of the present invention includes an inner holder, an outer can, a first check valve and a second check valve. The inner holder includes a storage space. The outer can includes a slidable variable space for the inner holder to slide therein. The inner holder is slidably provided in the slidable variable space. The outer can includes an air channel for the slidable variable space to communicate with an exterior. The inner holder includes an air hole for the storage space to communicate with the slidable variable space. The first check valve is provided on the air hole and seals the air hole, and has an airflow direction towards the slidable variable space. The second check valve is provided on the air channel and seals the air channel, and has an airflow direction towards the exterior.

Accordingly, the storage space can store commodities, and the actual volume of the slidable variable space is enlarged by holding and slidably moving the outer can outwards relative to the inner holder after the storage space is sealed. Further, a negative pressure environment is formed in the slidable variable space to suck out the air in the storage space, the outer can is slidably moved inwards towards the inner holder, and the actual volume of the slidable variable space can be compressed. When the actual volume of the slidable variable space is reduced and the pressure is increased, the air in the slidable variable space is discharged to the exterior. Thus, by repeating the sliding movement several times, the actual volume of the slidable variable space is repeatedly enlarged and reduced, hence gradually discharging the air in the storage space. Such a structure is simple, has an operating mode similar to that of an air pump, has simple manufacturing and assembly processes, and is not easily damaged, thus satisfying manufacturing and utilization requirements.

DETAILED DESCRIPTION OF THE PREFERRED EMBODIMENTS

Details and technical contents of the present invention are further given in the embodiments below.

Figure 1:
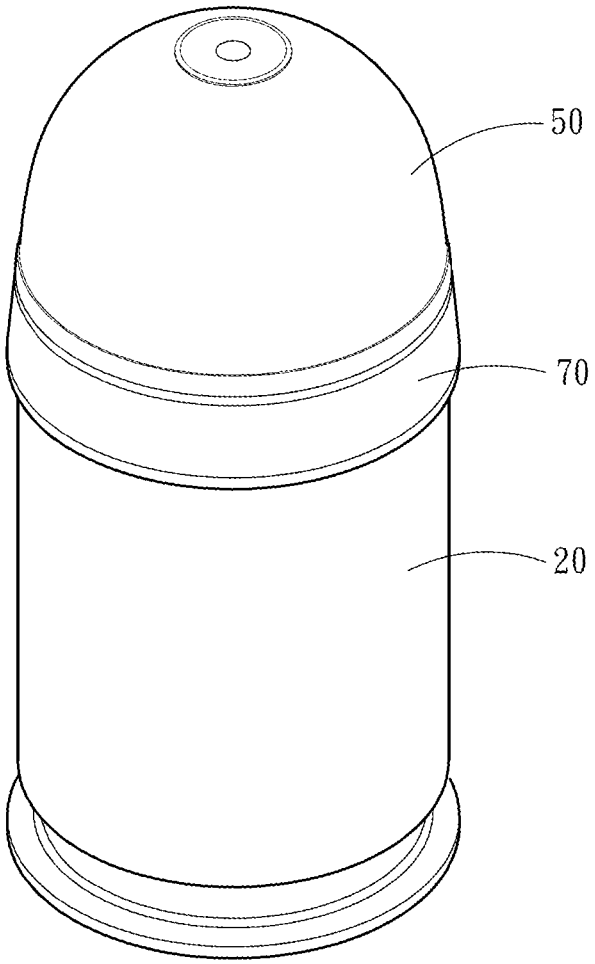
FIG. 1 is a structural diagram of the present invention.
Figure 2:
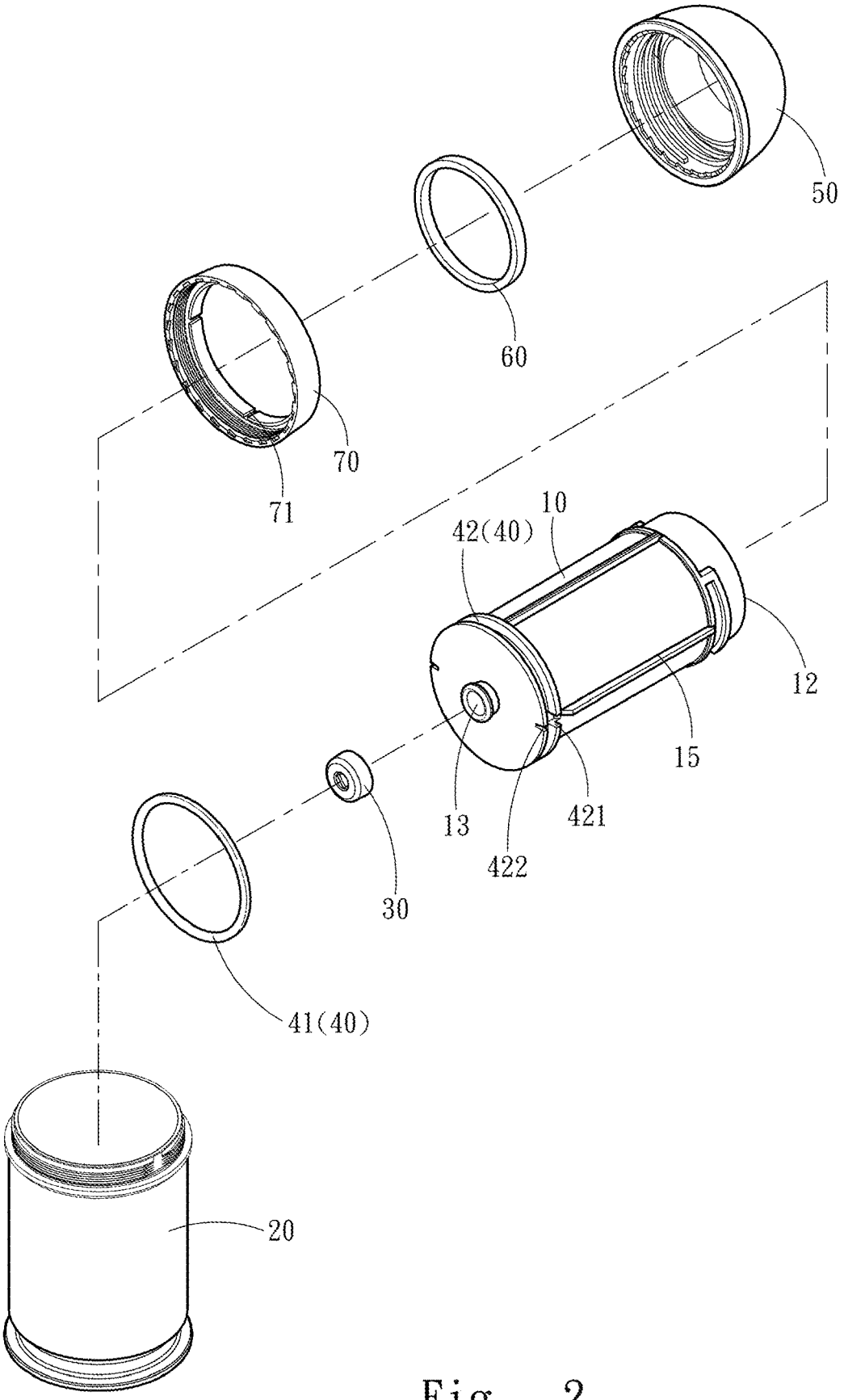
FIG. 2 is an exploded structural diagram of the present invention.
Figure 3:
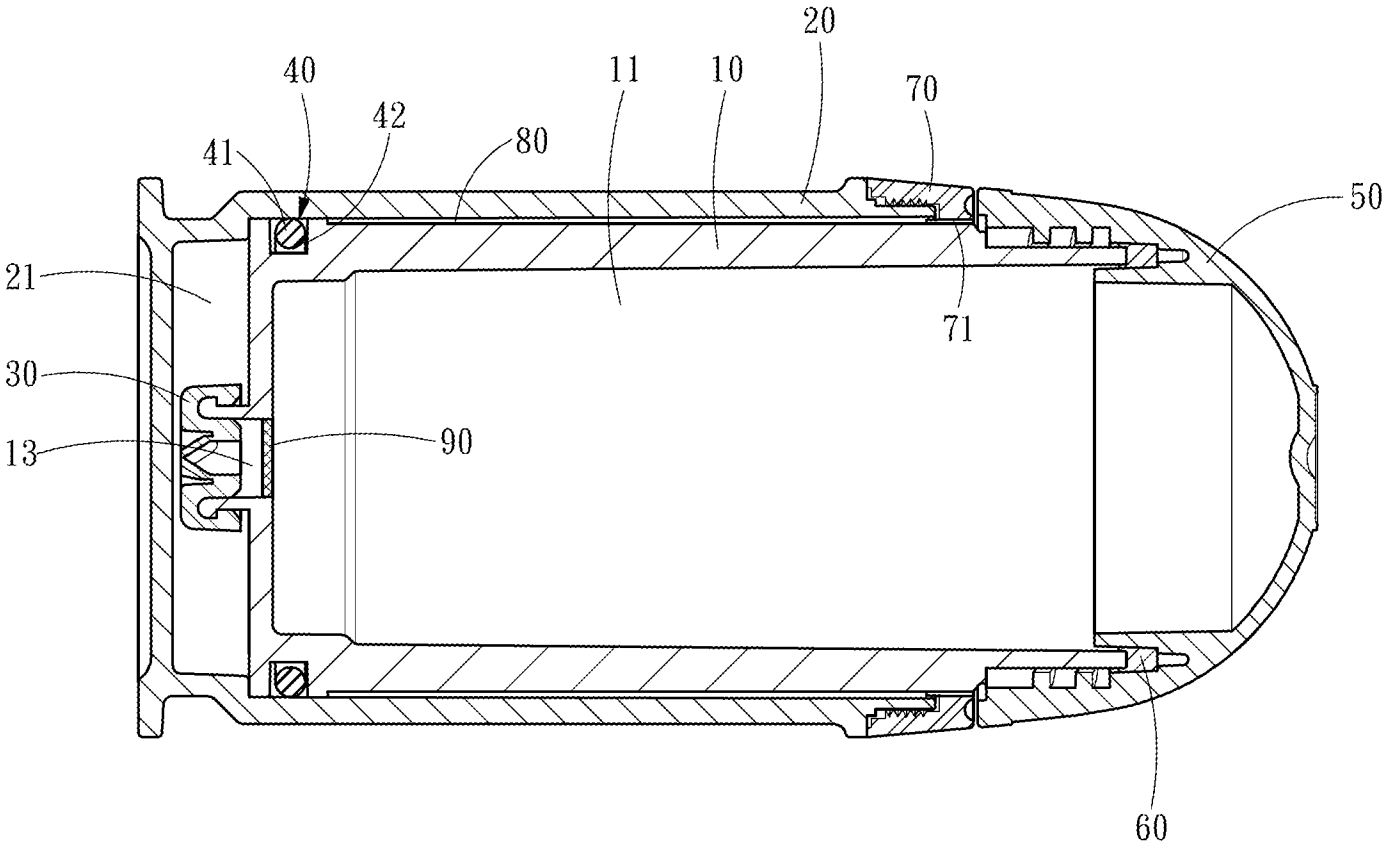
FIG. 3 is a section diagram of an assembly of the present invention.

Referring to FIG. 1, FIG. 2 and FIG. 3, a moisture-proof storage can of the present invention includes an inner holder 10, an outer can 20, a first check valve 30 and a second check valve 40. The inner holder 10 includes a storage space 11. The present invention may further include a sealing cover 50 and a silicone ring 60. The inner holder 10 includes a bottle opening end 12, on which the sealing cover 50 is fastened. The silicone ring 60 is located between the sealing cover 50 and the bottle opening end 12.

The outer can 20 includes a slidable variable space 21 for the inner holder 10 to slide therein. After the inner holder 10 is slid into the slidable variable space 21, a fastening ring 70 can be fastened at an opening of the slidable variable space 21 of the outer can 20. The fastening 70 retains the inner holder 10 from departing from the slidable variable space 21, so as to prevent the inner holder 10 from disengaging from the outer can 20. At least one rib 15 is provided on an outer surface of the inner holder 10, and the fastening ring 70 includes at least one fastening groove 71 for the ribs 15 to slide and be embedded therein. By the retention of the ribs 15 and the fastening grooves 71, the fastening ring 70 and the inner holder 10 are prohibited from any relative rotation therebetween; that is, the fastening ring 70 and the inner holder 10 are rotated coaxially to facilitate the user to open the sealing cover 50.

Further, the inner holder 10 is slidably provided on the slidable variable space 21, and the outer can 20 includes an air channel 80 for the slidable variable space 21 to communicate with an exterior. The air channel 80 may be directly formed on a wall surface of the outer can 20, or may be formed between the inner holder 10 and the outer can 20 as shown in FIG. 3, so as to allow the slidable variable space 21 to communicate with the exterior. The second check valve 40 is provided on the air channel 80 and seals the air channel 80, and has an airflow direction towards the exterior. If the air channel 80 is directly formed on the wall surface of the outer can 20, the second check valve 40 can be implemented by a common check valve. If the air channel 80 is formed between the inner holder 10 and the outer can 20, in the actual structure, the second check valve 40 includes a silicone ring 41 and a ring groove 42, wherein the silicone ring 41 encircles on the ring groove 42, the ring groove 42 is provided on an outer side of the inner holder 10, the silicone ring 41 has a height is slightly higher than that the of ring groove 42 to press against the outer can 20 and the inner holder 10 with two sides of the silicone ring 41. Further, at least one notch 421 is provided on one side of the ring groove 42 away from the slidable variable space 21. When the silicone ring 41 leans towards one side without the notches 421, the silicone ring 41 tightly presses against the outer can 20 and the inner 10 and prohibits any air from passing through, thus forming an airtight structure. When the silicone ring 41 leans towards one side with the notches 421, the silicone ring 41 falls into the notches 421 and cannot tightly press against the outer can 20, thus allowing air to pass through. The preferred number of the notches 421 is two and the notched 421 are symmetrically provided.

The inner holder 10 includes an air hole 13 for the storage space 11 to communicate with the slidable variable space 21. The first check valve 30 is provided on the air hole 13 and seals the air hole 13, and has an airflow direction towards the slidable variable space 21. The first check valve 30 may be implemented by a common unidirectional-flow check valve. A filter 90 covering the air hole 13 may be provided at a bottom part of the inner holder 10. The filter 90 may be made of a material such as non-woven fabric, which allows air to pass through and prohibits commodities having smaller particle diameters (as shown in FIG. 4A) to pass through the air hole 13.

Figure 4A:
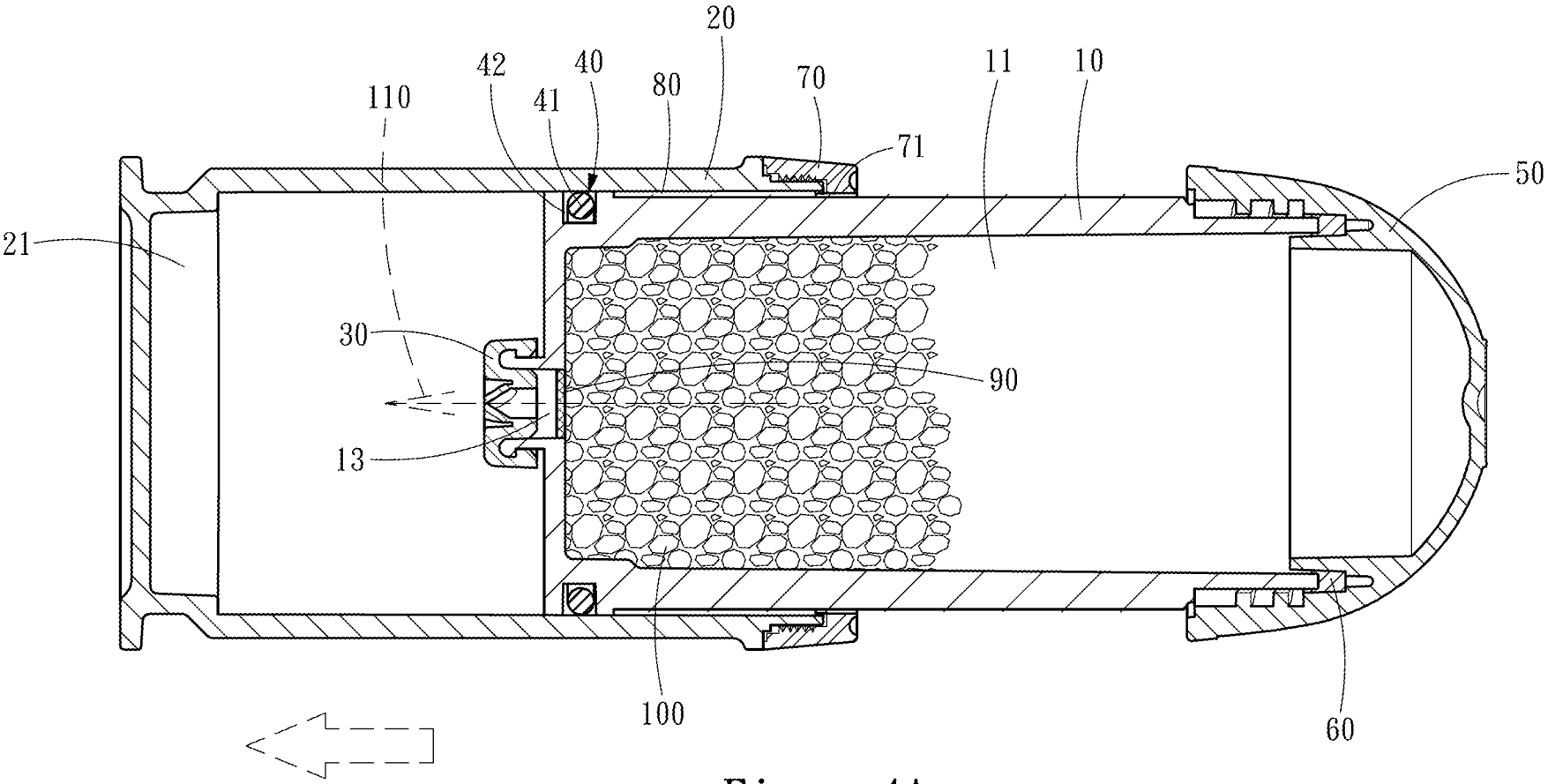
FIG. 4A is a schematic diagram of an enlarged slidable variable space of the present invention.
Figure 4B:
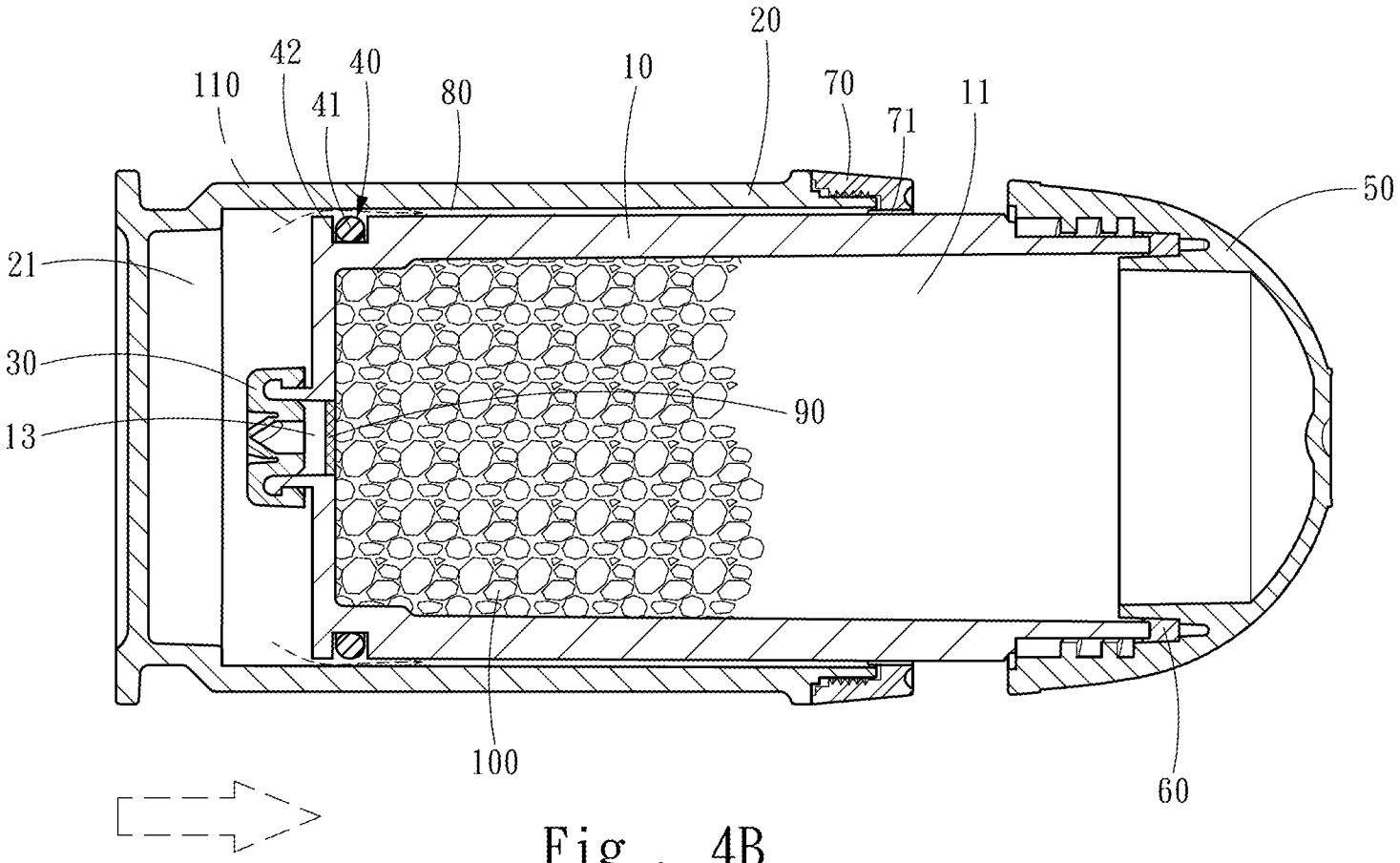
FIG. 4B is a schematic diagram of a reduced slidable variable space of the present invention.

Referring to FIG. 4A and FIG. 4B, the storage space 11 is provided for a user to store a commodity 100 therein. When the storage space 11 is sealed by the sealing cover 50, by holding and repeatedly slidably moving the outer can 20 relative to the inner holder 10 for several times by a user, the actual volume of the slidable variable space 21 can be repeated enlarged and reduced. When the actual volume of the slidable variable space 21 enlarges and the pressure decreases (as shown in FIG. 4A), air 110 in the storage space 11 enters the slidable variable space 21. When the actual volume of the slidable variable space 21 reduces and the pressure increases (as shown in FIG. 4B), the air 110 in the slidable variable space 21 is discharged to the exterior, thereby sucking out the air in the storage space 11.

Further, to reduce the force required for holding and slidably moving the outer can 20 outwards relative to the inner holder 10 for the user, in the present invention, at least one air release opening 422 is formed on one end of the ring groove 42 away from the notches 421 as shown in FIG. 2. When the user holds and slidably moves the outer can 20 outwards relative to the inner holder 10 and the actual volume of the slidable variable space 21 is enlarged and the pressure is decreased (as shown in FIG. 4A), the air release opening 422 can receive the silicone ring 41 in a recessed manner such that the silicone ring 41 no longer tightly presses against the outer can 20 and the inner holder 10, allowing some air from the exterior to enter the slidable variable space 21. Thus, the slidable variable space 21 can be kept at a low-pressure environment, and at the same time the pressure of the slidable variable space 21 does not become too low, thereby reducing the force required for holding and slidably moving the outer can 20.

Figure 5:
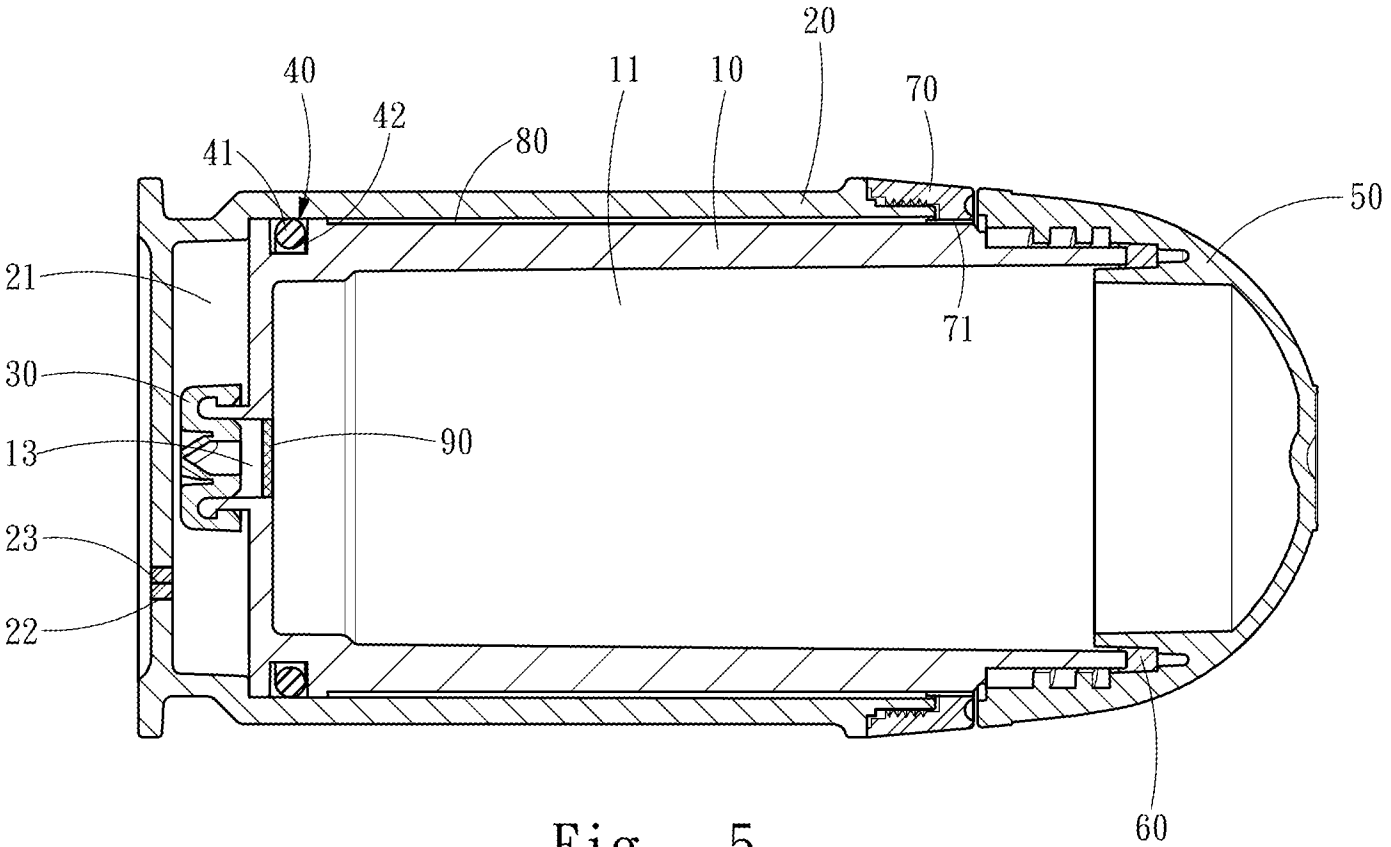
FIG. 5 is a structural diagram of an outer can according to another embodiment of the present invention.

Further, referring to FIG. 5, in the present invention, at least one air release hole 22 may be provided on the wall surface of the outer can 20. The air release holes 22 have an extremely small aperture and allow some air from the exterior to enter the slidable variable space 21. Thus, the pressure of the slidable variable space 21 similarly does not become too low, thereby reducing the force required for holding and slidably moving the outer can 20. Further, the user can block the air release holes 22 by a finger to control whether to allow air from the exterior to enter the slidable variable space 21 as desired, so as to meet the convenience of operation. Further, each of the air release holes 22 may be directly installed with an air blocking valve 23, which permits air with a certain pressure difference to pass through, hence similarly preventing the pressure in the slidable variable space 21 from becoming too low.

As described above, the present invention at least includes the advantages below.

1. The present invention has an operating mode similar to that of an air pump and is not easily damaged, thus satisfying utilization requirements.

2. The present invention has a simple structure as well as simple manufacturing and assembly processes and low costs, thus satisfying manufacturing requirements.

3. The fastening grooves and the ribs are provided between the fastening ring and the inner holder, allowing the fastening ring and the inner holder to rotate coaxially to facilitate opening of the sealing cover.

4. By using the filter covering the air hole, the storage space can be suitable for storing commodities having a smaller particle diameter.

5. With the design of the air release opening or the air release hole, the force required for holding and slidably moving the outer can outwards relative to the inner holder can be reduced for a user, meeting a user habit of repeated withdrawal.

What is claimed is:

1. A moisture-proof storage can, comprising:

an inner holder, including a storage space;

an outer can, including a slidable variable space for the inner holder to slide therein, the inner holder slidably provided in the slidable variable space, the outer can comprising an air channel located between the outer can and the inner holder for the slidable variable space to communicate with an exterior, and the inner holder having an air hole for the storage space to communicate with the slidable variable space;

a first check valve, provided on the air hole and sealing the air hole, and having an airflow direction towards the slidable variable space; and a second check valve, provided on the air channel and sealing the air channel, and having an airflow direction towards the exterior, wherein the second check valve comprises a silicone ring and a ring groove, the silicone ring encircles on the ring groove, the ring groove is provided on an outer side of the inner holder, the silicone ring has a height slightly higher than that of the ring groove and to press against the outer can and the inner holder with two sides of the silicone ring, and at least one notch is provided on one side of the ring groove away from the slidable variable space.

2. The moisture-proof storage can of claim 1, further comprising a sealing cover and a silicone ring, wherein the sealing cover is fastened on a bottle opening end of the inner holder, and the silicone ring is located between the sealing cover and the bottle opening end.

3. The moisture-proof storage can of claim 1, wherein the outer can further comprises a fastening ring fastened at an opening of the slidable variable space of the outer can after the inner holder is slid into the slidable variable space, and the fastening ring retains the inner holder from departing from the slidable variable space.

4. The moisture-proof storage can of claim 3, wherein at least one rib is provided on an outer surface of the inner holder, and the fastening ring includes at least one fastening groove for slidably embedding the ribs.

5. The moisture-proof storage can of claim 1, wherein the notches are a quantity of two and are symmetrically provided.

6. The moisture-proof storage can of claim 1, wherein at least one air release opening is formed on one end of the ring groove away from the notches.

7. The moisture-proof storage can of claim 1, wherein at least one air release hole is provided on a wall surface of the outer can.

8. The moisture-proof storage can of claim 7, wherein each of the air release holes is installed with an air blocking valve.

9. The moisture-proof storage can of claim 1, wherein a filter covering the air hole is provided at a bottom part of the inner holder.

* * * * *